US006670532B2

(12) United States Patent
Maehara

(10) Patent No.: US 6,670,532 B2
(45) Date of Patent: Dec. 30, 2003

(54) LEGS FORMED FROM LAMINATED WOODY BOARD AND KEYBOARD MUSICAL INSTRUMENT USING THE SAME

(75) Inventor: Kazuo Maehara, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 146 days.

(21) Appl. No.: 09/954,145

(22) Filed: Sep. 14, 2001

(65) Prior Publication Data

US 2002/0035910 A1 Mar. 28, 2002

(30) Foreign Application Priority Data

Sep. 25, 2000 (JP) ..... 2000-291069

(51) Int. Cl.[7] ..... G10C 1/00
(52) U.S. Cl. ..... 84/174; 84/185
(58) Field of Search ..... 84/174, 185, 186.1, 84/190, 193, 243

(56) References Cited

U.S. PATENT DOCUMENTS

| | | | | |
|---|---|---|---|---|
| 2,232,445 A | | 2/1941 | Gazlay | |
| 2,640,527 A | | 6/1953 | Kreizelman | |
| 3,001,433 A | | 9/1961 | Merkel | |
| 4,297,937 A | * | 11/1981 | Mayerjak | 84/430 |
| 5,062,618 A | * | 11/1991 | Yamada et al. | 267/140.4 |
| 5,237,935 A | * | 8/1993 | Newhouse et al. | 108/50.02 |
| 5,558,735 A | * | 9/1996 | Rettew et al. | 156/275.5 |

FOREIGN PATENT DOCUMENTS

| | | |
|---|---|---|
| DE | 3417292 A1 | 11/1985 |
| JP | 10078773 A | 3/1998 |
| JP | 10091146 A | 4/1998 |

* cited by examiner

*Primary Examiner*—Kimberly Lockett
(74) *Attorney, Agent, or Firm*—Morrison & Foerster LLP

(57) ABSTRACT

A keyboard musical instrument such as a piano has legs for supporting a piano case on a floor, a pair of glued laminated woody members like an L-letter, a pair of decorative plates and a caster are assembled into the leg, and the pair of glued laminated woody members is directly bolted to the piano case so that the legs are hardly broken even when large bending moment is exerted on the legs during relocation of the piano.

20 Claims, 11 Drawing Sheets

LEGS FORMED FROM LAMINATED WOODY BOARD AND KEYBOARD MUSICAL INSTRUMENT USING THE SAME

FIELD OF THE INVENTION

This invention relates to a keyboard musical instrument and, more particularly, to a leg for supporting a musical instrument and a keyboard musical instrument having a case supported by legs on a floor.

DESCRIPTION OF THE RELATED ART

An acoustic piano is a typical example of the keyboard musical instrument. The acoustic piano is broken down into a keyboard, piano case and tone generating mechanism. Key actions, hammers, dampers and strings form parts of the tone generating mechanism. The tone generating mechanism is accommodated in the piano case, and is actuated with the keys for generating tones. The keys are laid on the well-known black-and-white pattern, and are essential parts of the keyboard. The keyboard is mounted on the key bed which forms a part of the piano case, and is exposed to a pianist for fingering.

FIG. 1 shows a typical example of the grand piano. Reference numerals 100, 120 and 140 designate the piano case, the keyboard and the tone generating mechanism, respectively. The piano case 100 has a case body 101 and three legs 102. A key bed 101*a* and a frame (not shown) define the bottom of the piano case 100, and a side board 101*b* extends along the periphery of the key bed 101*a* and the frame. Thus, the key bed 101*a*, the frame and the side board 101*b* define an inner space of the case body 101, and permits the manufacturer to install the tone generating mechanism 140 in the case body 101. A top board 108 is hinged to the side board 101*b*, and is opened and closed.

Three legs 102 are arranged at the vertexes of a triangle under the case body 101. Two legs 102 are arranged in substantially parallel, and are directly bolted to the key bed 101*a*. The remaining leg 102 is provided at the back of the two legs 102, and is fixed to the frame.

The leg 102 is not a monolithic body. Various woody parts are assembled into the leg 102 as shown in FIG. 2. A leg column 103, a leg block 104 and a caster 105 are the essential parts of the leg 102. The leg column 103 and the leg block 104 are formed of wood. The leg column 103 is an inverted prismoid. A tenon 103A is formed on the relatively wide top surface, and the caster 105 is attached to the relatively narrow bottom surface of the leg column 103. The tenon 103A is a short cylindrical projection, and two slits 103B are formed in the tenon 103A. The slits 103B extend across the upper surfaces of the tenon 103A in parallel to each other, and are exposed to the side surface of the tenon 103A. The leg block 104 has an anvil-like configuration. The leg block 104 is gently increased in thickness from both ends toward the mid portion, and a cylindrical hole 104A is formed in the mid portion. The cylindrical hole 104A is open to both of the upper and lower surfaces of the mid portion, and is equal in diameter to the tenon 103A. A pair of through-holes 104B is formed in the leg block 104. The through-holes 104B are provided on both sides of the cylindrical hole 104A. Though not shown in the drawings, threaded holes are formed in the key bed 101A, and are spaced equally to the through-holes 104B.

The leg column 103 and the leg block 104 are assembled into the leg 102 as follows. First, the worker aligns the tenon 103A with the cylindrical hole 104A, and inserts the tenon

103A into the cylindrical hole 104A. The lower surface of the leg block 104 is brought into contact with the upper surface of the leg column 103, and the upper surface of the tenon 103A becomes coplanar with the upper surface of the leg block 104. The worker pushes the edge of a wedge 107 into one of the slits 103B, and another wedge 107 into the other slit 103B. The worker strikes the wedges 107 with a hammer, by way of example. Then, the wedges 107 are implanted into the tenon 103A, and expands the slits 103B. The upper portion of the tenon 103 is pressed against the inner surface of the leg block 104, and the leg block 104 is fixed to the leg column 103.

The leg 102 thus assembled is fixed to the key bed 101*a* as follows. The worker aligns the through-holes 104B with the threaded holes formed in the key bed 101*a*. The worker inserts a bolt 106 into one of the through-holes 104B, and screws the bolt 106 into the threaded hole. Similarly, the worker inserts another bolt 106 into the other of the through-holes 104B, and screws the bolt 106 into the other threaded hole. Thus, the leg block 104 is bolted to the key bed 101*a*, and the leg 102 downwardly projects from the case body 101.

A problem is encountered in the prior art keyboard musical instrument in that the piano case 100 is liable to be rickety.

SUMMARY OF THE INVENTION

It is therefore an important object of the present invention to provide a keyboard musical instrument the case of which is steady and durable.

The present inventor contemplated the problem encountered in the prior art keyboard musical instrument, and noticed that the wedges 107 failed to work. The present inventor reasoned that the connection between the tenon 103A and the leg block 104 was repeatedly subjected to the bending moment. When the user wanted to relocate the prior art keyboard musical instrument, he or she pushed the case body 101, and exerted force thereon. The force gave rise to rotation of the casters 105, and the prior art keyboard musical instrument slid on the floor. However, the casters 105 were vertically spaced from the case body 101 on which the force was exerted. This resulted in that bending moment was exerted on the connection between the tenon 103A and the leg block 104. The slits 103B were strangulated, and, accordingly, the wedges 107 were partially pushed out. As a result, the tenon 103A was loosened, and the piano case 101 became rickety.

A solution had been proposed. Plural bolts were embedded into the upper portion of the leg column 103, and through-holes were formed in the leg block 104. The bolts were inserted into the through-holes, and projected over the leg block 104. The worker turned nuts on the bolts, and held the bolts in their places with nuts. However, the solution was costly and risky. Time and labor were consumed in the implantation of the bolts into the leg column 103. This resulted in the high production cost. Moreover, the leg column 103 was not thick enough to receive the plural bolts. When the worker compelled the leg column 103 to receive plural bolts, extremely thin peripheral portion took place between the implanted bolt and the outer surface of the leg column 103, and was liable to be broken under the application of the bending moment. The present inventor concluded that a monolithic leg was preferable. However, a monolithic leg shaped from a piece of wood was extremely expense.

To accomplish the object, the present invention proposes to form laminated members into a core of a leg.

In accordance with one aspect of the present invention, there is provided a leg incorporated in a keyboard musical instrument, and the leg comprises plural plates laminated on one another and assembled into a core and a coupling means for fixing the core to a body of the keyboard musical instrument.

In accordance with another aspect of the present invention, there is provided a keyboard musical instrument comprising a case having an inner space, a keyboard mounted on the case and having keys assigned notes of a scale, a tone generating mechanism accommodated in the inner space and connected to the keyboard for generating tones with the notes and plural legs, and each of the legs includes plural plates laminated on one another and assembled into a core and a coupling means for fixing the core to the body.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENTS

First Embodiment

Figure 1:
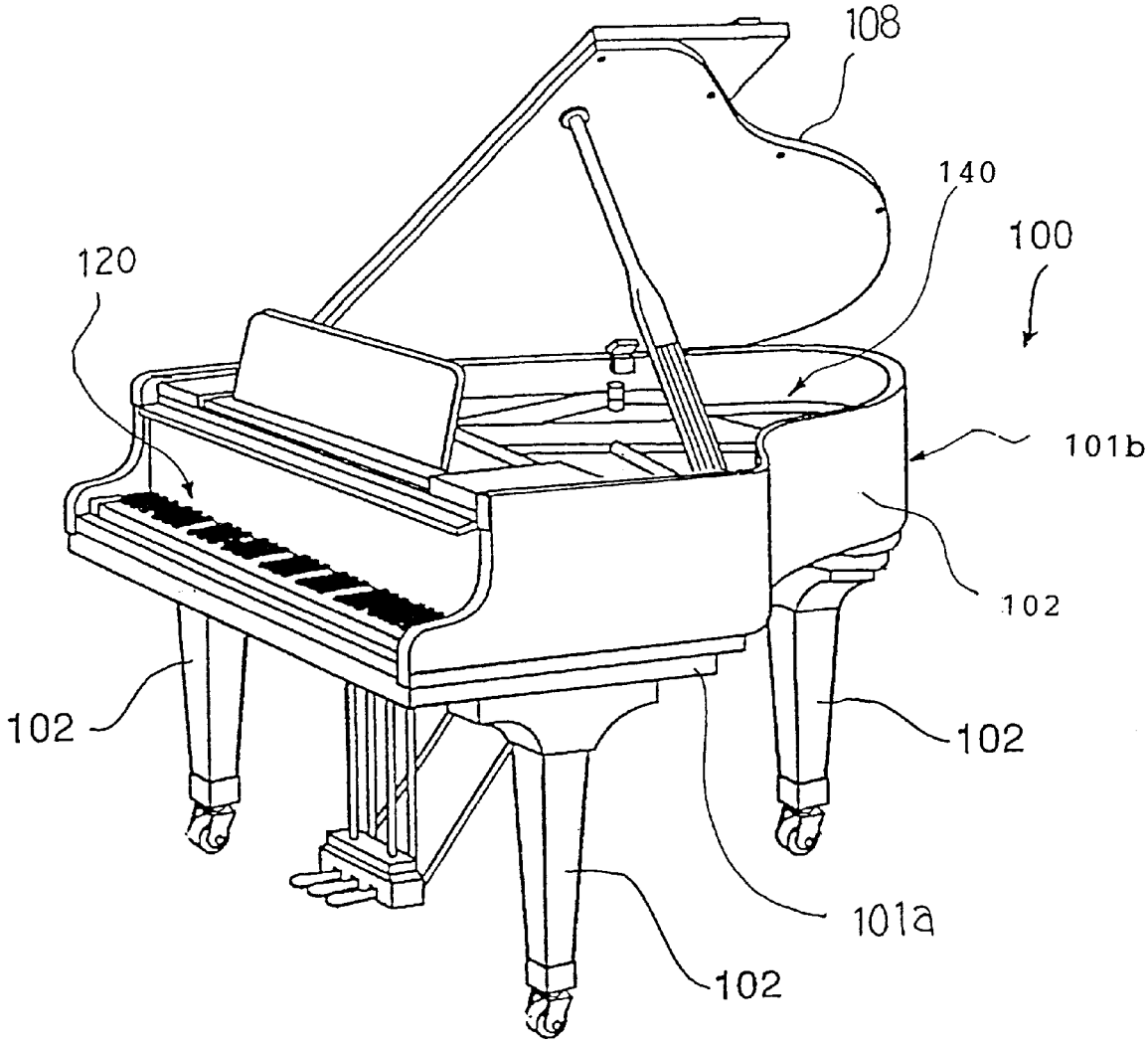
Fig. 1 PRIOR ART
FIG. 1 is a perspective view showing the external appearance of the prior art grand piano.
Figure 2:
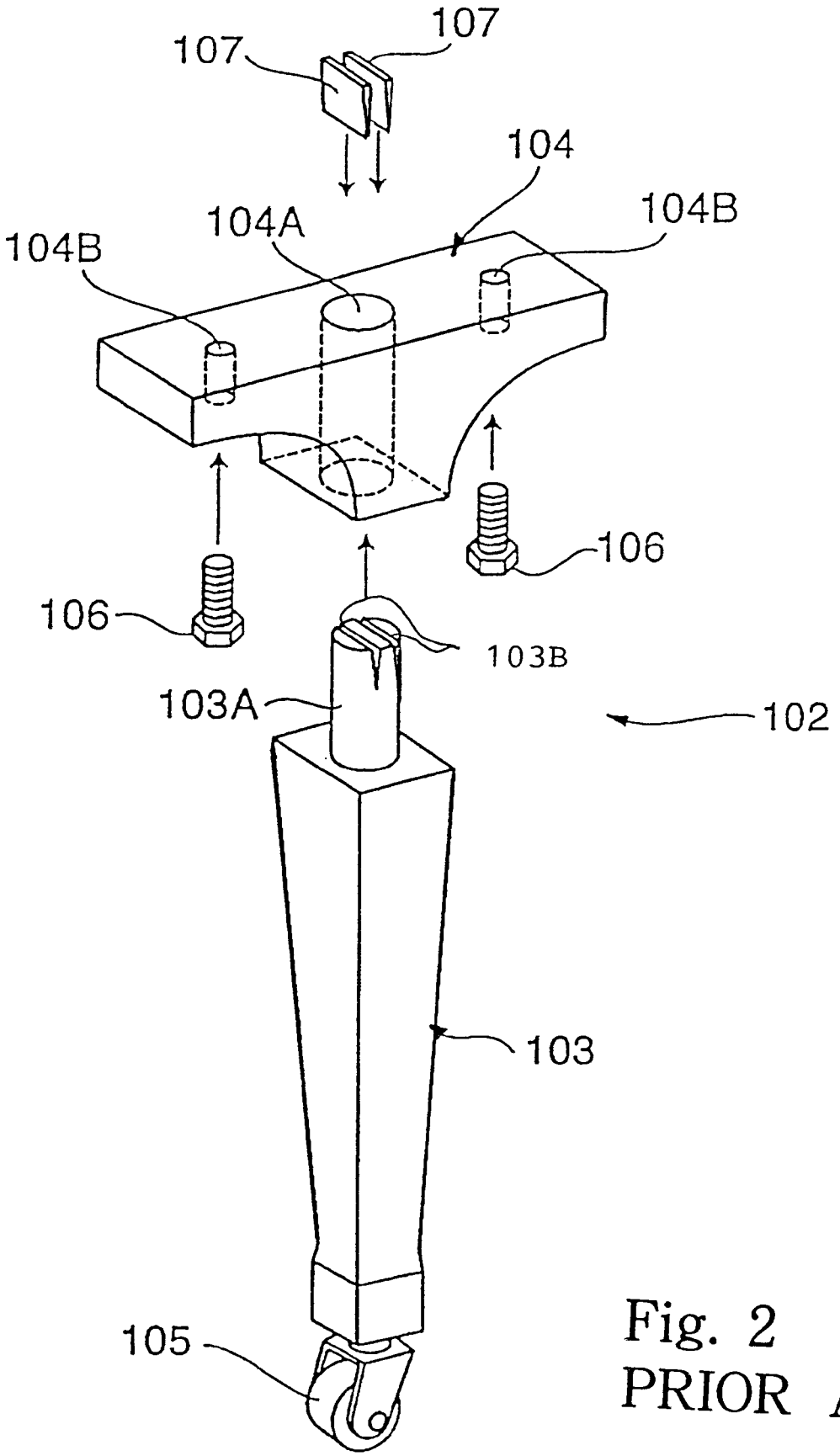
Fig. 2 PRIOR ART
FIG. 2 is a fragmentary perspective view showing the parts to be assembled into the leg.
Figure 3:
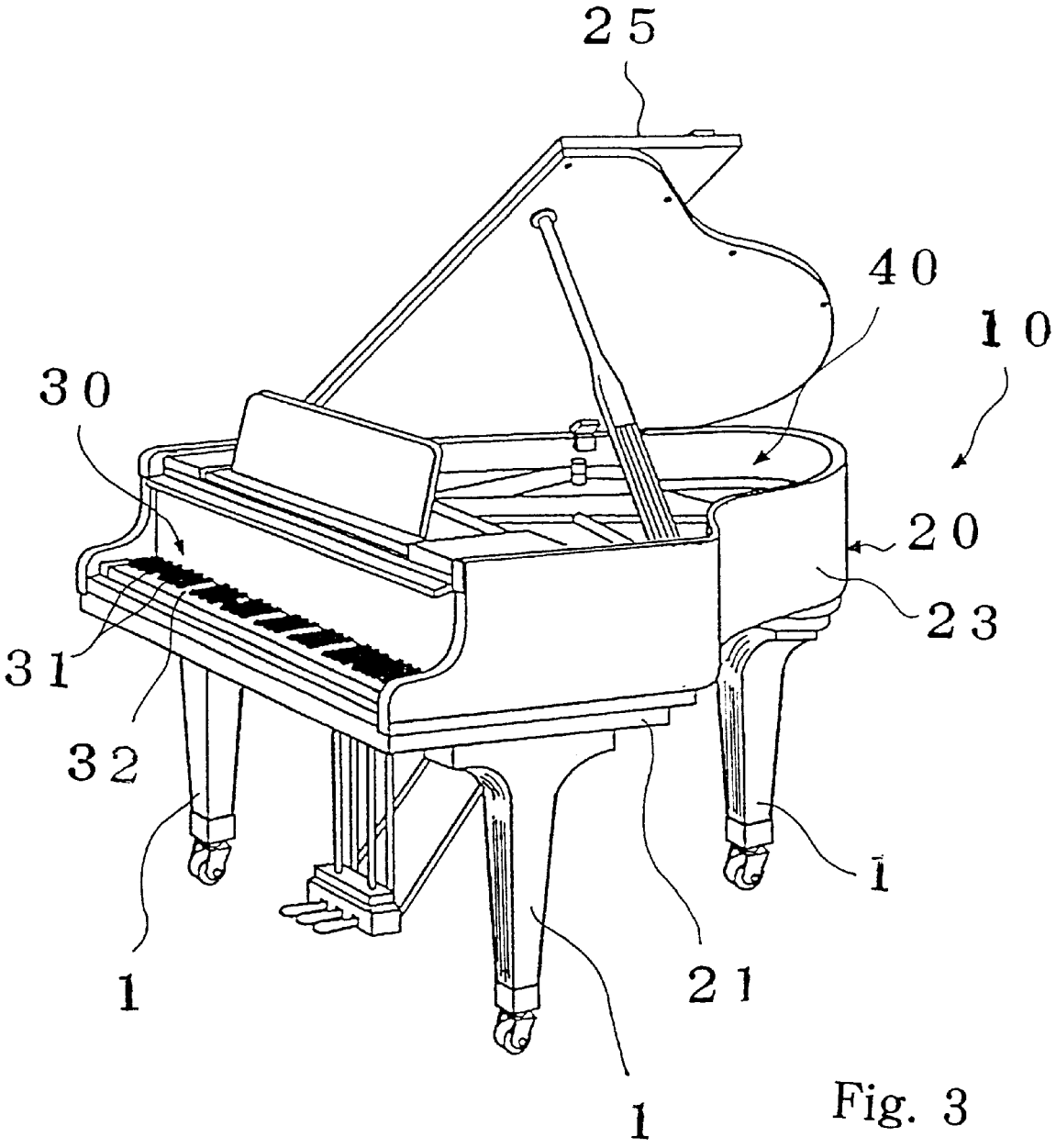
FIG. 3 is a perspective view showing the external appearance of a keyboard musical instrument according to the present invention.

Referring first to FIG. 3 of the drawings, a grand piano embodying the present invention largely comprises a piano case 10, a keyboard 30 and a tone generating mechanism 40. In the following description, word "front" indicates a position closer to a pianist fingering a piece of music on the keyboard 30 than another position modified with word "rear".

The keyboard 30 includes plural black keys 31 and white keys 32, and these black and white keys 31/32 are laid on the well-known pattern. While a pianist is playing a tune on the keyboard 30, the pianist selectively depresses the black and white keys 31/32, and the depressed keys 31/32 actuate the tone generating mechanism 40 for generating tones.

The tone generating mechanism 40 includes key actions, hammers, dampers and strings. The key actions are linked with the black and white keys 31/32, and are selectively actuated by the depressed keys 31/32. The key actions are engaged with the hammers, and the hammers are driven for rotation through an escape by the associated key actions linked with the depressed keys 31/32. The dampers are held in contact with the associated strings in so far as the associated keys 31/32 are staying at the rest positions. When the pianist depresses a black or white key 31/32, the associated key action causes the damper to be spaced from the string before the escape. Thus, the damper allows the string to vibrate before the rotation of the hammer. The hammer travels in the trajectory toward the string, and strikes the associated string. The string vibrates so as to generate the tone. The hammer rebounds on the string, and returns toward the key action. When the pianist releases the depressed key, the black/ white key 31/32 returns toward the rest position, permits the hammer and the key action to return to the rest positions.

The piano case 10 is broken down into legs 1, case body 20 and a top board 25. The case body 20 is supported by three legs 1, and has an upper opening. The top board 25 is hinged to the case body 20, and is opened and closed by the pianist.

A key bed 21 and frame (not shown) define the bottom of the case body 20, and a side board 23 extends along the periphery of the bottom. Thus, the key bed 21, the frame and the side board 23 defines an inner space of the case body 20. The tone generating mechanism 40 is accommodated in the inner space. The keyboard 30 is mounted on a front portion of the key bed 21, and the tone generating mechanism 40 occupies the inner space over the rear portion of the key bed 21.

Figure 4:
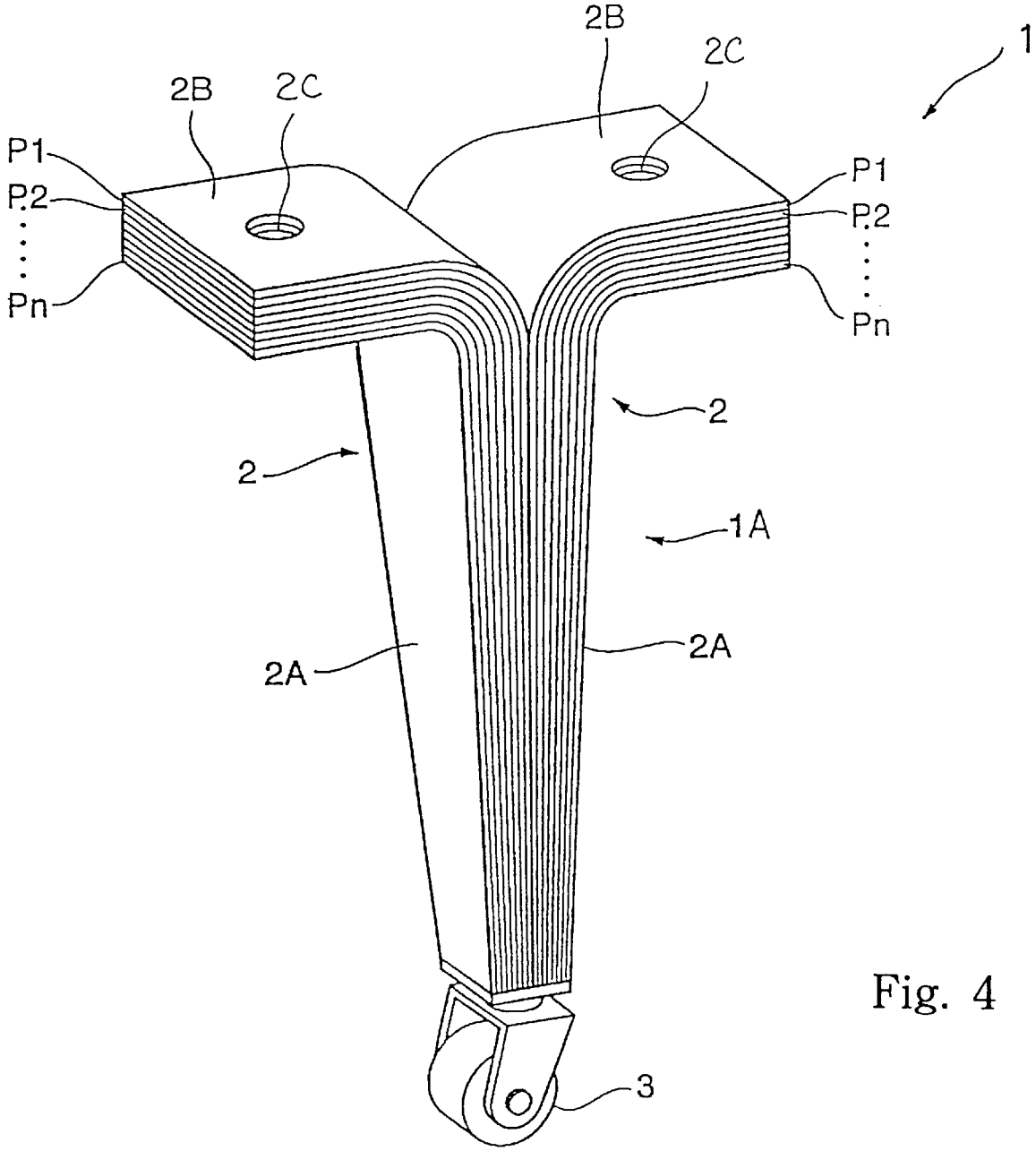
FIG. 4 is a perspective view showing the structure of a core forming a part of a leg incorporated in the keyboard musical instrument.

The legs 1 downwardly project from the case body 20, and occupy the vertexes of a triangle. Namely, two legs 1 are fixed to the key bed 21, and the other leg 1 is fixed to the frame. The three legs 1 are similar in structure to one another, and description is made on one of the legs 1 with reference to FIG. 4.

Figure 5A:
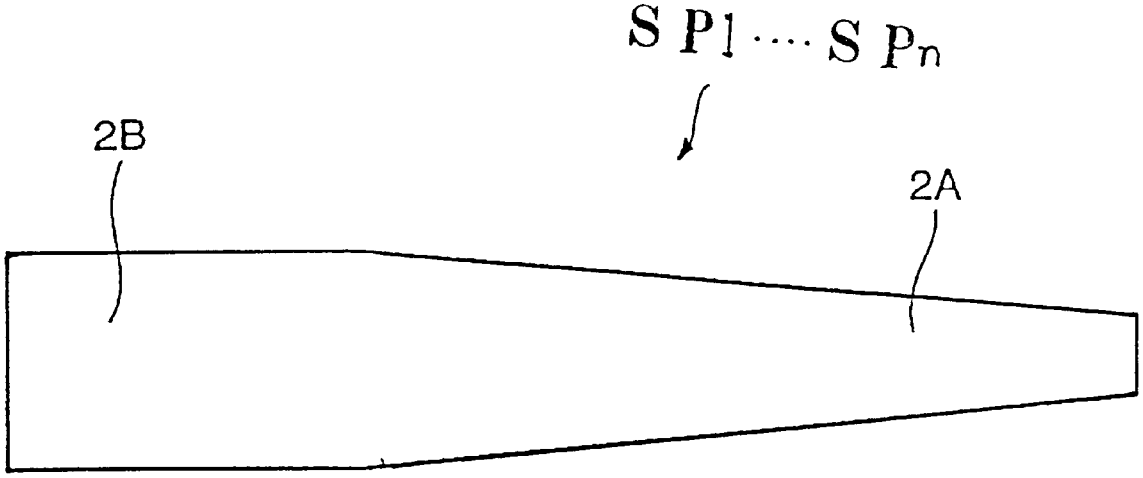
FIGS. 5A to 5D are perspective views showing a process for fabricating the leg according to the present invention.
Figure 5B:
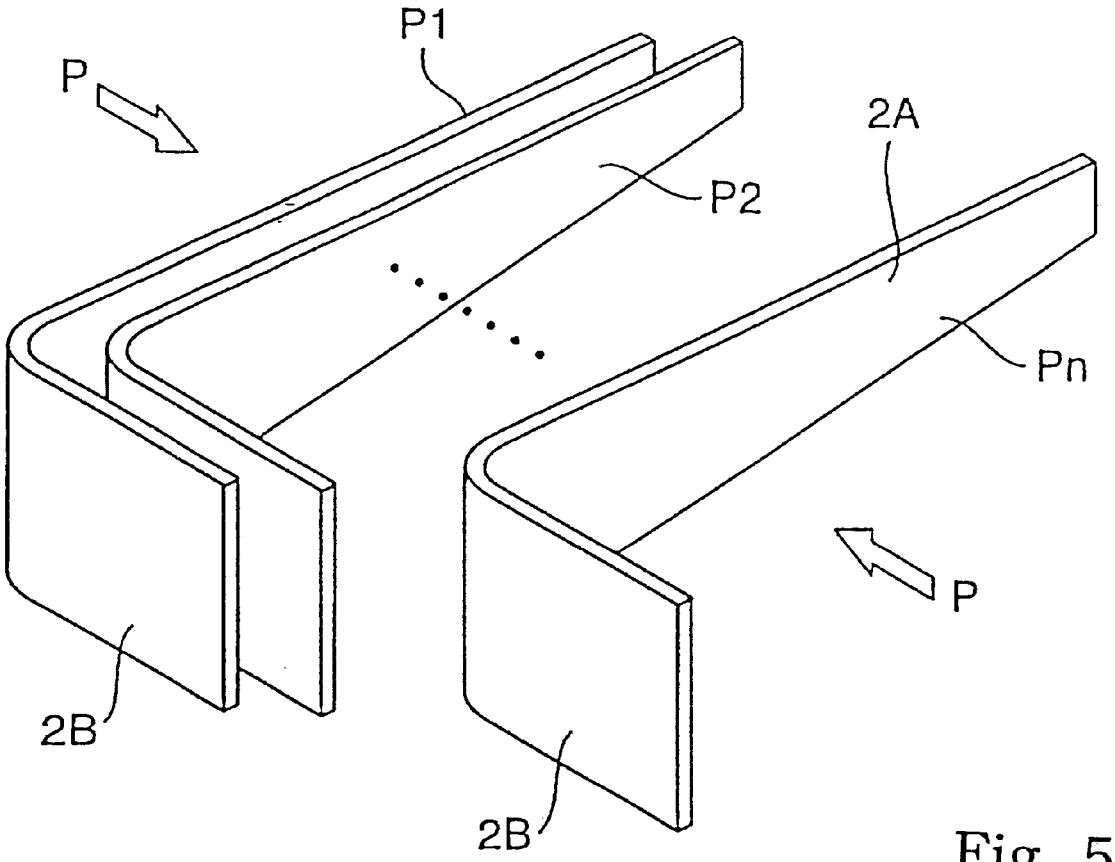
Figure 5C:
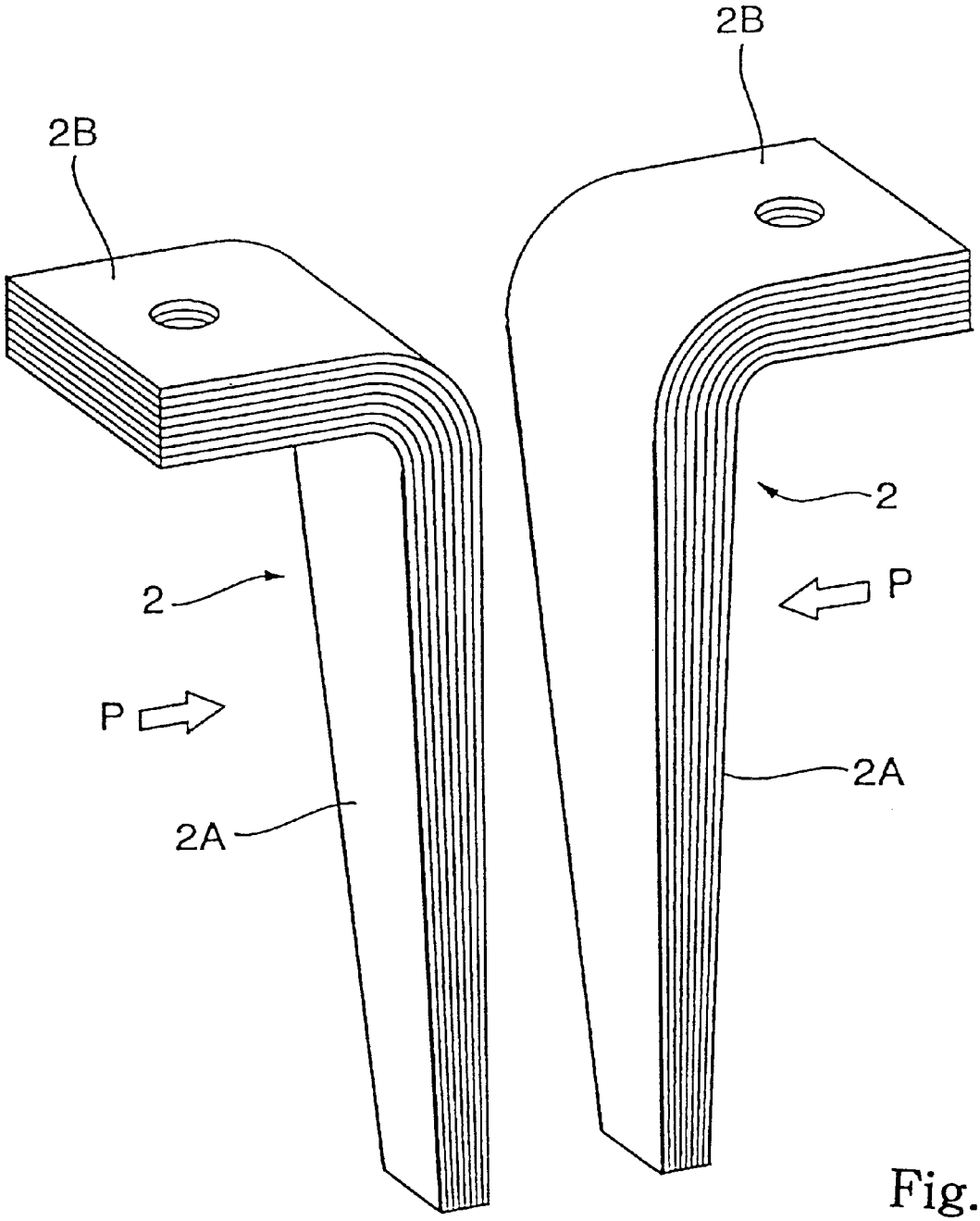
Figure 5D:
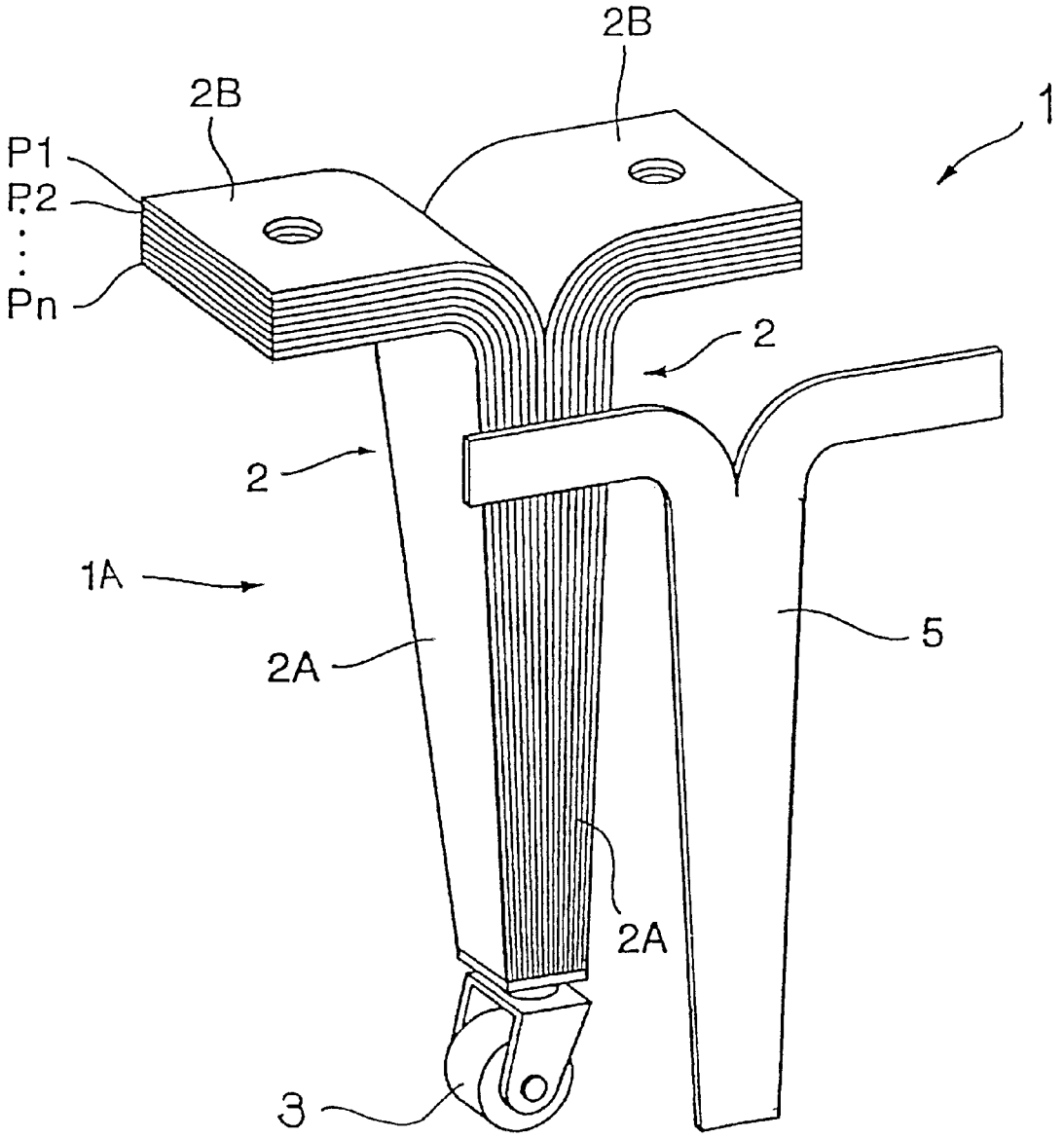

The leg 1 is broken down into a core 1A, a caster 3 and a pair of decorative panels 5 (see FIG. 5D). The core 1A consists of a pair of glued laminated woody members 2. Each of the glued laminated woody members 2 is formed from a plurality of thin wood plates P1, P2, . . . and Pn or plywood. Plural sheets of veneer may be used as the plurality of thin wood plates P1, P2, . . . and Pn. The plural thin wood plates P1, P2, . . . and Pn are concentrically curved, and are laminated on one another. The thin wood plates P1, P2, . . . and Pn are glued with adhesive compound. The glued laminated woody members 2 have an inverted L-letter shape, and have respective long portions 2A and respective short portions 2B. The glued laminated woody members 2 are directed in such a manner that the long portions 2A are faced in the opposite directions, and are fixed to each other. Thus, the glued laminated woody members 2 are symmetrically arranged with respect to the contact surface between the long portions 2A, and are assembled into the core 1A. The decorative panels 5 have a contour corresponding to the front and back surfaces of the core 1A. One of the decorative panels 5 is adhered to the front surface of the core 1A, and the other decorative panel 5 is adhered to the back surface. Thus, the decorative panels 5 put the boundaries between the plural thin wood plates P1, P2, . . . and Pn out of sight.

Through-holes 2C are formed in the short portions 2B, and permit bolts to pass therethrough. The bolts are corresponding to the bolts 106, and serve as a coupling means.

The short portions 2B are held in contact with the lower surface of the key bed 21 or the frame, and the core 1A is fixed to the key bed 21 or the frame by means of the bolts together with the decorative panels 5. The caster 3 is fixed to the lower surface of the core 1A.

As will be understood, the monolithic legs 1 are used in the grand piano according to the present invention. The monolithic leg 1 is equivalent to the leg column 103 and the leg block 104. However, any coupling means such as the tenon 103A, the through-hole 104A and the wedges 107 are not required. For this reason, even though the bending moment is exerted on the legs 1 during the relocation of the grand piano, the bolts well withstand the bending moment without looseness. Thus, the grand piano according to the present invention is steady and durable.

The monolithic leg 1 is fabricated through a process according to the present invention. FIGS. 5A to 5D show the process sequence. First, straight thin wood plates SP1, . . . and SPn are prepared as shown in FIG. 5A. The straight thin wood plates SP1, . . . and SPn may be shaped by using a wood working machine or a blanking. The straight thin wood plate SP1/ . . . /SPn is partially constant in width, and the remaining portion 2A is tapered toward the other end. The constant width portions 2B are corresponding to the short portions 2B of the glued laminated woody members 2, and the tapered portions 2A are corresponding to the long portions 2A of the glued laminated woody members 2.

Subsequently, adhesive compound is spread over the contact surfaces of the straight thin wood plates SP1, . . . and SPn, and the straight thin wood plates SP1, . . . and SPn are placed in a bending press machine. Force F is exerted on the straight thin wood plates SP1, . . . and SPn, and are formed into the glued laminated woody member 2 as shown in FIG. 5B. The constant width portions 2B are formed into the short portion 2B corresponding to the leg block 104, and the tapered portions 2A are formed into the long portion 2A corresponding to the leg column 103.

Subsequently, adhesive compound is spread over the back surfaces of the glued laminated woody members 2, and the glued laminated woody members 2 are assembled in such a manner that the long portions 2A are brought into back-to-back contact with each other as shown in FIG. 5C. The glued laminated woody members 2 are clamped under application of force P. The adhesive compound fixes the glued laminated woody members 2 to each other, and the core 1A is obtained.

The caster 3 is fixed to the bottom surface of the core 1A, and the decorative panels 5 are adhered to the front and back surfaces of the core 1A as shown in FIG. 5D. Thus, the core 1A, the caster 3 and the decorative panels 5 are assembled into the monolithic leg 1.

As will be appreciated, the monolithic leg 1 is obtained through the wood machining, bending press and adhesion. These steps are less expensive rather than the shaping from a piece of wood. Thus, the monolithic leg 1 is lower in production cost than a monolithic leg 1 shaped from a piece of wood.

Second Embodiment

Figure 6:
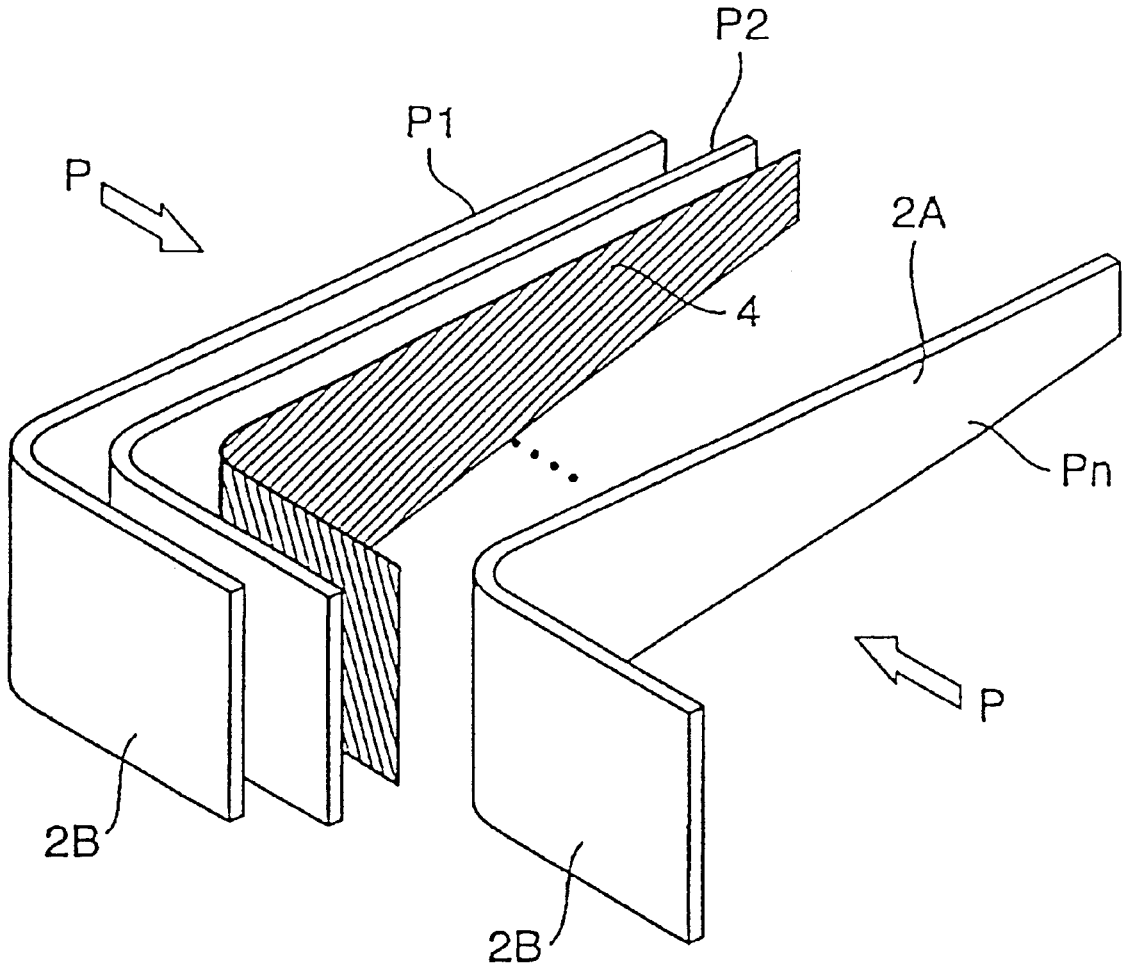
FIG. 6 is a fragmentary perspective view showing a glued laminated woody member forming a part of a core of a leg incorporated in another keyboard musical instrument according to the present invention.

Turning to FIG. 6 of the drawings, a reinforcing sheet 4 is inserted between the thin wood plate P2 and P2+1. The thin wood plate P2+1 is not shown in FIG. 6, and the reinforcing sheet 4 is hatched for easily discriminating it. Although only one reinforcing sheet 4 is shown, more than one reinforcing sheet 4 may be inserted into the set of thin wood plates P1, P2, . . . and Pn. The reinforcing sheet 4 is shaped as similar to the thin wood plates P1, P2, . . . and Pn. Any kind of material is available for the reinforcing plate 4 in so far as the reinforcing sheet 4 of the selected material enhances the mechanical strength of the monolithic leg implementing the second embodiment. The reinforcing sheet 4 is flexible or rigid. However, it is preferable to shape a sheet of selected material into the contour same as the thin wood plates P1, P2, . . . and Pn. A sheet of metallic fiber fabric, a sheet of synthetic resin fiber fabric, a sheet of carbon fiber fabric and a sheet of carbon fiber reinforced synthetic resin is, by way of example, appropriate for the sheet to be shaped into the reinforcing sheet 4.

The reinforcing sheet or sheets 4 and the thin wood plates P1, P2, . . . and Pn are formed into the glued laminated woody member 2, and a pair of glued laminated woody members 2 are assembled into the core 1A. The caster 3 is fixed to the lower surface of the core 1A, and the decorative panels 5 are adhered to the front and back surfaces of the core 1A as similar to the leg 1 of the first embodiment.

The monolithic legs implementing the second embodiment are bolted to the case body 20 of the grand piano. Since the monolithic legs are enhanced in mechanical strength, the grand piano is further steady and durable.

Third Embodiment

Figure 7:
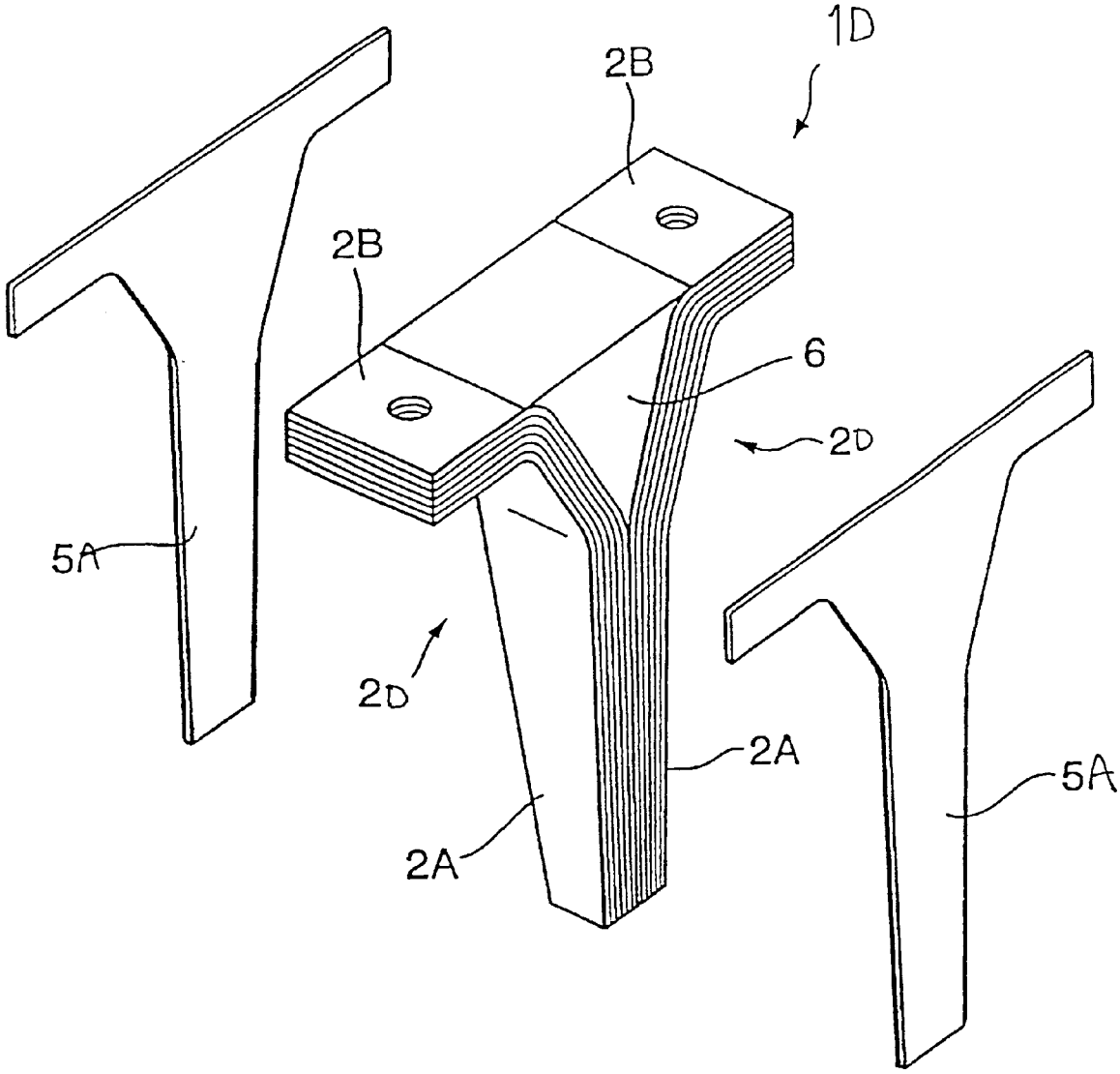
FIG. 7 is a fragmentary perspective view showing a glued laminated woody member forming a part of a core of a leg incorporated in yet another keyboard musical instrument according to the present invention.

Turning to FIG. 7, a pair of glued laminated woody members 2D and a reinforcing block 6 are assembled into a core 1D. Straight thin wood plates are twice bent, and are adhered to one another. A reinforcing sheet or sheets may be inserted into the set of thin wood plates. Adhesive compound is spread over the back surface of the glued laminated timbres 2D, and the glued laminated woody members 2D are brought into back-to-back contact with one another. When the adhesive compound is cured, the glued laminated woody members 2D are assembled like a Y-letter, and the short portions 2B are spaced from each other. Thus, a trigonal prism-like space takes place between the short portions 2B. The reinforcing block 6 has the contour corresponding to the trigonal prism-like space. When the reinforcing block 6 is inserted into the trigonal prism-like space, the sloping surfaces of the reinforcing block 6 are held in face-to-face contact with the oblique surfaces between the long portions 2A and the short portions 2B. The reinforcing block 6 is adhered to the oblique surfaces of the core 1D.

Though not shown in FIG. 7, a caster is fixed to the lower surface of the core 1D. Decorative panels 5A are adhered to the front surface and the black surface of the core 1D. The monolithic legs implementing the third embodiment are fixed to the case body 20 of a keyboard musical instrument, and render the keyboard musical instrument steady and durable.

The reinforcing block 6 enhances the mechanical strength of the monolithic leg, and is, accordingly, desirable. The monolithic leg implementing the third embodiment has external appearance like the conventional leg 102.

As will be appreciated from the foregoing description, the legs according to the present invention are hardly broken by virtue of the monolithic structure, and render the keyboard musical instrument steady and durable.

Moreover, the process for fabricating the monolithic leg according to the present invention is economical rather than a monolithic leg shaped from a single piece of wood.

Although particular embodiments of the present invention have been shown and described, it will be apparent to those skilled in the art that various changes and modifications may be made without departing from the spirit and scope of the present invention.

The leg according to the present invention may be used for another kind of keyboard musical instrument such as, for example, an upright piano, a silent piano, an automatic player piano, an organ, a harpsichord, a celesta and an electric keyboard.

The silent piano is a kind of composite musical instrument. An acoustic piano is combined with an electronic tone generating system, and a hammer stopper is provided between the hammers and the strings. The hammer stopper is changed between a free position and a blocking position. While the hammer stopper is staying at the free position, the strings are struck with the hammers as usual. However, when the hammer stopper is changed to the blocking position, the hammer stopper enters the trajectories of the hammers. While a pianist is playing a tune on the keyboard, the depressed keys give rise to rotation of the hammers, and the hammers rebound on the hammer stopper before striking the strings. Thus, the pianist can practice the fingering without any piano tone. The electronic tone generating system includes key sensors, which monitor the black and white keys, respectively. The key sensors generate key position signals representative of the current key positions of the associated keys. The key position signals are supplied from the key sensors to a controller. The controller periodically checks the key position signals to see whether or not any one of the black and white keys changes the current key position. When the controller notices a depressed key, the controller specifies the depressed key, and calculates the key velocity. The controller produces music data codes such as, for example, MIDI (Musical Instrument Digital Interface) data words representative of the key motion, and supplies the music data codes to a tone generator. The tone generator generates an audio signal from the music data codes, and supplies the audio signal to a sound system. Thus, the pianist can confirm his fingering through the electronic tones.

The automatic player piano includes an automatic playing system in an acoustic piano. The automatic playing system has solenoid-operated key actuators and a controller. The solenoid-operated key actuators are, by way of example, provided on or in a key bed, and are respectively associated with the black and white keys. A set of music data codes representative of a performance are supplied to the controller, and the controller sequentially generates driving signals from the set of music data codes. The driving signals are selectively supplied to the solenoid-operated key actuators. Then, the solenoid-operated key actuators project the plungers, and the plungers move the associated black and white keys. As a result, the hammers strike the associated strings, and the original performance is reproduced by the automatic playing system. The hammer stopper may be installed in the automatic player piano.

The laminated board may be formed from a plurality of thin plates formed of synthetic resin or fiber-reinforced synthetic resin. Carbon-fiber reinforced synthetic resin sheets are also available for the laminated board.

The core 1A and the caster 3 may be assembled into a leg without the decorative panels 5.

Figure 8:
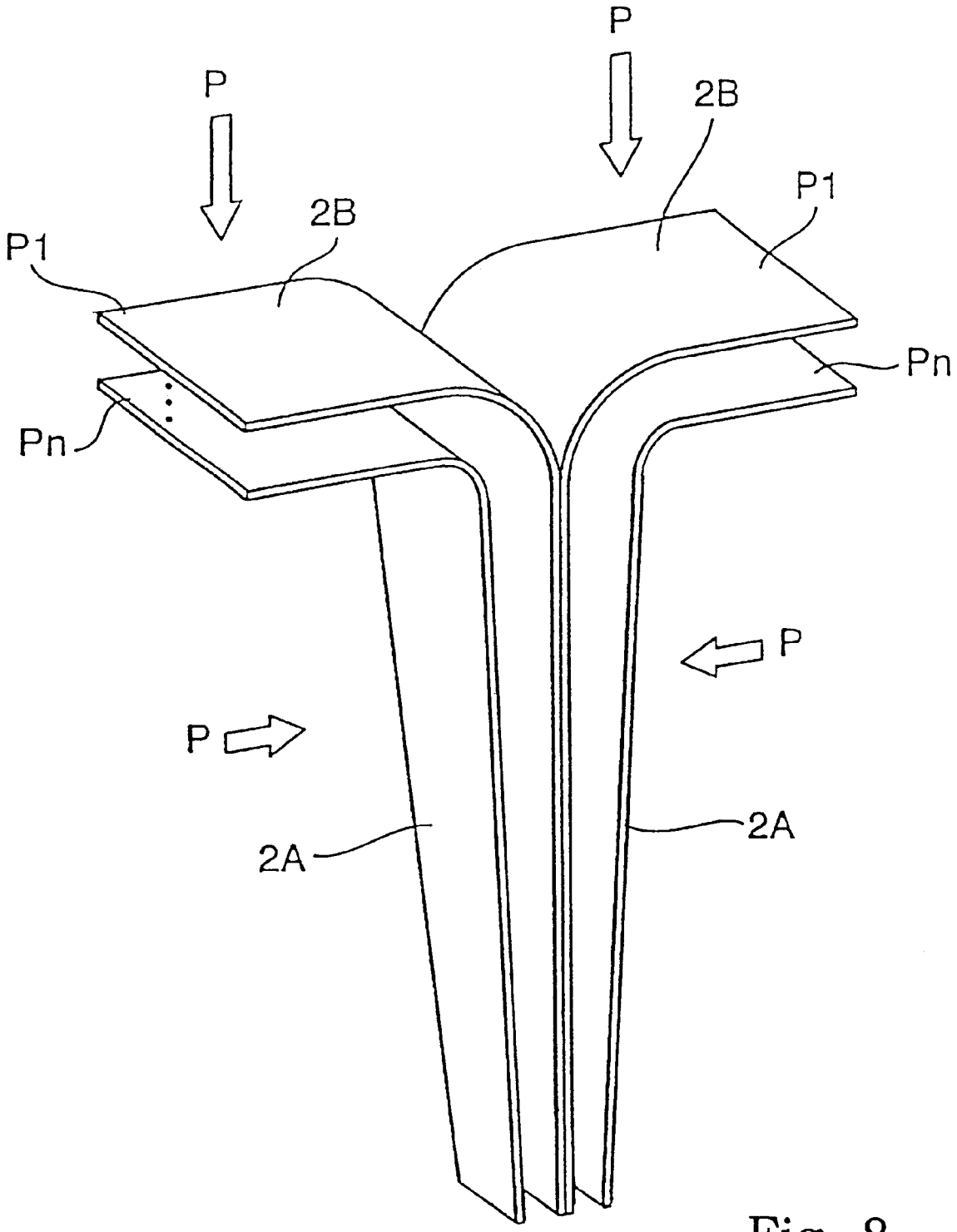
FIG. 8 is a perspective view showing a step incorporated in another process for fabricating a leg according to the present invention.

Two sets of thin wood plates P1, P2, . . . and Pn may be formed into the core 1A as shown in FIG. 8. In detail, adhesive compound is spread over the contact surfaces of the thin wood plates P1, P2, . . . and Pn of the two sets as well as the back surfaces of the thin wood plates Pn. The two sets of thin wood plates P1, P2, . . . and Pn are laminated, and are clamped with force P. The two sets of thin wood plates P1, P2, . . . and Pn are formed into the core 1A. Thus, the step shown in FIG. 8 is corresponding to the steps shown in FIGS. 5B and 5C.

The caster may be retractable into the core. If a keyboard musical instrument is light, the caster may be replaced with a non-slip block, or the core is directly placed on a floor. Thus, the caster is not an indispensable element of the monolithic leg according to the present invention.

The plural thin wood plates may be assembled into the core by means of a suitable clamp.

What is claimed is:

1. A leg incorporated in a keyboard musical instrument, comprising:

plural plates laminated on one another and formed into a pair of laminations, said pair of laminations assembled into a core in such a manner as to be symmetrical with respect to a boundary therebetween, said core having a vertical portion and a connecting portion merged with said vertical portion and wider than said vertical portion; and a coupling means for fixing said connecting portion to a body of said keyboard musical instrument.

2. The leg as set forth in claim 1, in which said plural plates are concentrically curved so as to form said vertical portion and said connecting portion.

3. The leg as set forth in claim 1, in which said plural plates are assembled into said pair of laminations by means of adhesive compound.

4. The leg as set forth in claim 1, in which said plural plates are concentrically curved so as to form half of said vertical portion and half of said connecting portion in said pair of laminations, respectively.

5. The leg as set forth in claim 1, in which said pair of laminations provide halves of said vertical portion held in face-to-face contact with each other and halves of said connecting portion merged into said halves of said vertical portion and spaced from each other, wherein said leg further comprises a reinforcing block placed into a space between said halves of said connecting portion and fixed to said laminations for enhancing a mechanical strength of said core.

6. The leg as set forth in claim 1, in which at least one reinforcing sheet is inserted into said plural plates for enhancing a mechanical strength of said core.

7. The leg as set forth in claim 6, in which said at least one reinforcing sheet is formed of a material selected from the group consisting of a metallic fiber fabric, a synthetic resin fiber fabric and a carbon fiber fabric.

8. The leg as set forth in claim 1, further comprising plural decorative panels fixed to certain surfaces of said core where boundaries between said plural plates are exposed.

9. The leg as set forth in claim 1, further comprising a caster connected to said core for permitting said keyboard musical instrument to slide.

10. The leg as set forth in claim 1, in which each of said plural plates is formed by a sheet of veneer.

11. A keyboard musical instrument comprising:

a case having an inner space;

a keyboard mounted on said case, and having keys assigned notes of a scale;

a tone generating mechanism accommodated in said inner space, and connected to said keyboard for generating tones with said notes; and plural legs each including plural plates laminated on one another and formed into a pair of laminations, said pair of laminations assembled into a core in such a manner as to be symmetrical with respect to a boundary therebetween, said core having a vertical portion and a connecting portion merged with said vertical portion and a wider than said vertical portion; and a coupling means for fixing said connecting portion to a body of said keyboard musical instrument.

12. The keyboard musical instrument as set forth in claim 11, in which said plural plates are concentrically curved so as to form said vertical portion and said connecting portion.

13. The keyboard musical instrument as set forth in claim 11, in which said plural plates are assembled into said pair of laminations by means of adhesive compound.

14. The keyboard musical instrument s set forth in claim 11, in which said plural plates are concentrically curved so as to form half of said vertical portion and half of said connecting portion in said pair of laminations, respectively, and said coupling means fixes said connecting portion to said case.

15. The keyboard musical instrument as set forth in claim 11, in which said pair of laminations provide halves of said vertical portion held in face-to-face contact with each other and halves of said connecting portion merged into said halves of said vertical portion and spaced from each other, wherein said leg further comprises a reinforcing block placed into a space between said halves of said connecting portion and fixed to said laminations for enhancing a mechanical strength of said core.

16. The keyboard musical instrument as set forth in claim 11, in which at least one reinforcing sheet is inserted into said plural plates for enhancing a mechanical strength of said core.

17. The keyboard musical instrument as set forth in claim 16, in which said at least one reinforcing sheet is formed of a material selected from the group consisting of a metallic fiber fabric, a synthetic resin fiber fabric and a carbon fiber fabric.

18. The keyboard musical instrument as set forth in claim 11, further comprising plural decorative panels fixed to certain surfaces of said core where boundaries between said plural plates are exposed.

19. The keyboard musical instrument as set forth in claim 18, further comprising a caster connected to said core for permitting said keyboard musical instrument to slide.

20. The keyboard musical instrument as set forth in claim 11, in which each of said plural plates is formed by a sheet of veneer.

* * * * *